US005967121A

United States Patent [19]

Pirch et al.

[11] Patent Number: 5,967,121

[45] Date of Patent: Oct. 19, 1999

[54] UNIT AND SNAP-ACTION DEVICE THEREFOR

[75] Inventors: Gerhard Pirch, Stuttgart; Erwin Krimmer, Pluderhausen; Udo Hafner, Ludwigsburg; Wolfgang Schulz, Bissingen; Claus Sax, Gaggenau; Tilman Miehle, Kernen; Rolf Bald, Bad Wimpfen; Manfred Zimmermann, Bad Rappenau; Bernd Koch, Moglingen, all of Germany

[73] Assignee: Robert Bosch GmbH, Stuttgart, Germany

[21] Appl. No.: 09/000,084

[22] PCT Filed: Nov. 20, 1996

[86] PCT No.: PCT/DE96/02208

§ 371 Date: Jan. 26, 1998

§ 102(e) Date: Jan. 26, 1998

[87] PCT Pub. No.: WO97/45635

PCT Pub. Date: Dec. 4, 1997

[30] Foreign Application Priority Data

May 25, 1996 [DE] Germany ..... 196 21 221

[51] Int. Cl.[6] ..... F02M 55/02

[52] U.S. Cl. ..... 123/470; 123/520; 123/458

[58] Field of Search ..... 123/470, 472, 123/469, 468, 509, 458, 520, 521, 518, 519, 516

[56] References Cited

U.S. PATENT DOCUMENTS

| | | | |
|---|---|---|---|
| 4,747,384 | 5/1988 | Hafner | 123/470 |
| 4,829,965 | 5/1989 | Gartner | 123/470 |
| 4,950,171 | 8/1990 | Muzslay | 123/456 |
| 5,012,789 | 5/1991 | Fehrenbach | 123/467 |
| 5,058,555 | 10/1991 | Haboush | 123/456 |
| 5,299,542 | 4/1994 | Hafner | 123/470 |
| 5,413,082 | 5/1995 | Cook | 123/458 |
| 5,551,400 | 9/1996 | Rice | 123/470 |
| 5,724,946 | 3/1998 | Franchitto | 123/470 |
| 5,727,532 | 3/1998 | Everingham | 123/458 |
| 5,803,056 | 9/1998 | Cook | 123/458 |

*Primary Examiner*—Carl S. Miller

*Attorney, Agent, or Firm*—Edwin E. Greigg; Ronald E. Greigg

[57] ABSTRACT

A simplified, economical, noise-abating mode of securing a unit embodied for instance as a valve. For securing the unit, the unit has a housing with a first portion having a first encompassing outer face and at least one second portion having at least one second encompassing outer face, wherein a first sealing ring can be mounted on the first outer face, and the first portion and first sealing ring can be introduced into a recess of an installation wall. A second sealing ring can be mounted on the second outer face of the second portion, and the second portion and second sealing ring can likewise be introduced into the recess, so that the support of the unit in the recess is effected by means of the first and second sealing rings without the first and second outer faces of the unit resting on inner faces of the recess. The installation wall has a tubular protruberance, into which the recess extends and which is subdivided, for retaining the unit, into a plurality of bendable ring-snap elements, into which the second sealing ring can be snapped when the unit is introduced into the recess. The unit according to the invention and the snap device for the unit are intended in particular for valves for metered introduction of evaporated fuel into an intake conduit of the internal combustion engine.

29 Claims, 3 Drawing Sheets

UNIT AND SNAP-ACTION DEVICE THEREFOR

PRIOR ART

The invention is based on a unit and a snap device for a unit. Once such unit in the form of a valve is already known (European Patent Application EP-0 582 297), to which fuel is delivered via an inflow neck provided on the valve, so that the fuel can then be metered out from an outflow neck into an intake conduit of an intake module. The inflow neck of the valve is connected, for instance via a hose, to an absorption filter, which temporarily stores the fuel vapors that have evaporated from a fuel tank of the internal combustion engines and carries them to the valve via the hose. The housing of the valve is embodied as cylindrical and stepped, and it is composed of one outer face of larger cross section and another outer face, of smaller cross section, that forms the outflow neck. The valve is introduced into a recess embodied in stepped fashion to correspond to the outer faces of the valve, the recess being composed of one part of larger cross section and one part of smaller cross section. Between the part of larger cross section and the part of smaller cross section, a shoulder is formed, which acts as a stop when the valve moves into the recess.

In the recess of the intake module, a sealing ring, which is provided solely to seal off the outflow neck in the recess, is mounted on the outer face of smaller cross section of the outflow neck. In the installed state of the valve, the valve rests in the recess on the shoulder with an annular valve face. The outer face of larger cross section of the valve also rests on an inner face of the part of larger cross section in the recess. To secure the valve, the outer face of larger cross section of the valve has an annular bead extending around the circumference and protruding radially from the outer face. A clamping ring, joined to the intake module in a manner connected to the housing and extending only partway in the circumferential direction, is provided, which when the valve is introduced into the recess is bent upward somewhat by the annular bead and subsequently bends back again, so as to hold the valve between the end face of the intake module and the annular bead.

This valve, also known to one skilled in the art is a tank venting valve or regeneration valve, is embodied electromagnetically actuatably and has an electromagnet, which acts upon an armature with a valve closing member, so that the fuel flowing into the valve via the inflow neck can be dispensed in clocked fashion from the outflow neck into the intake conduit of the intake module. The clocked mode of triggering the valve has the disadvantage, however, of producing relatively loud noise in valve operation. When the valve is accommodated in a recess of the intake module as described, the outer face and the annular face of the valve are in contact with the inner face and the shoulder of the recess, respectively, thereby even increasing the operating noise of the valve. Moreover, forming an annular bead on the valve housing is relatively complex to accomplish in engineering terms, and makes for relatively high production costs in mass production. Mounting and unmounting the valve by means of a clamping ring is also relatively complicated and expensive.

The aforementioned disadvantages also apply to units in the form of injection valves (U.S. Pat. No. 5,156,133, British Patent GB 1 603 501), exhaust recirculating valves (WO 95/27134), and other valves (U.S. Pat. No. 5,497,746) . Even in internal combustion engines equipped with so-called ram intake tube supercharging in which a switchover valve (German Patent Disclosure DE-OS 41 05 938) can switch between two lengths of section tube, for instance, the aforementioned disadvantages still occur.

ADVANTAGES OF THE INVENTION

The unit and the snap device having the characteristics of, have the advantage over the prior art that in a simple way, the unit is disposed and secured with noise abatement, and the unit causes only quiet operating noise and can be mounted and unmounted without major effort or expense.

It is particularly advantageous that the unit can be produced in a simple, economical way and in particular be mounted on the intake module and also unmounted in a simple way by means of the snap connection.

BRIEF DESCRIPTION OF THE DRAWINGS

Exemplary embodiments of the invention are shown in simplified form in the drawings and described in further detail in the ensuing description.

DESCRIPTION OF THE EXEMPLARY EMBODIMENTS

Figure 1:
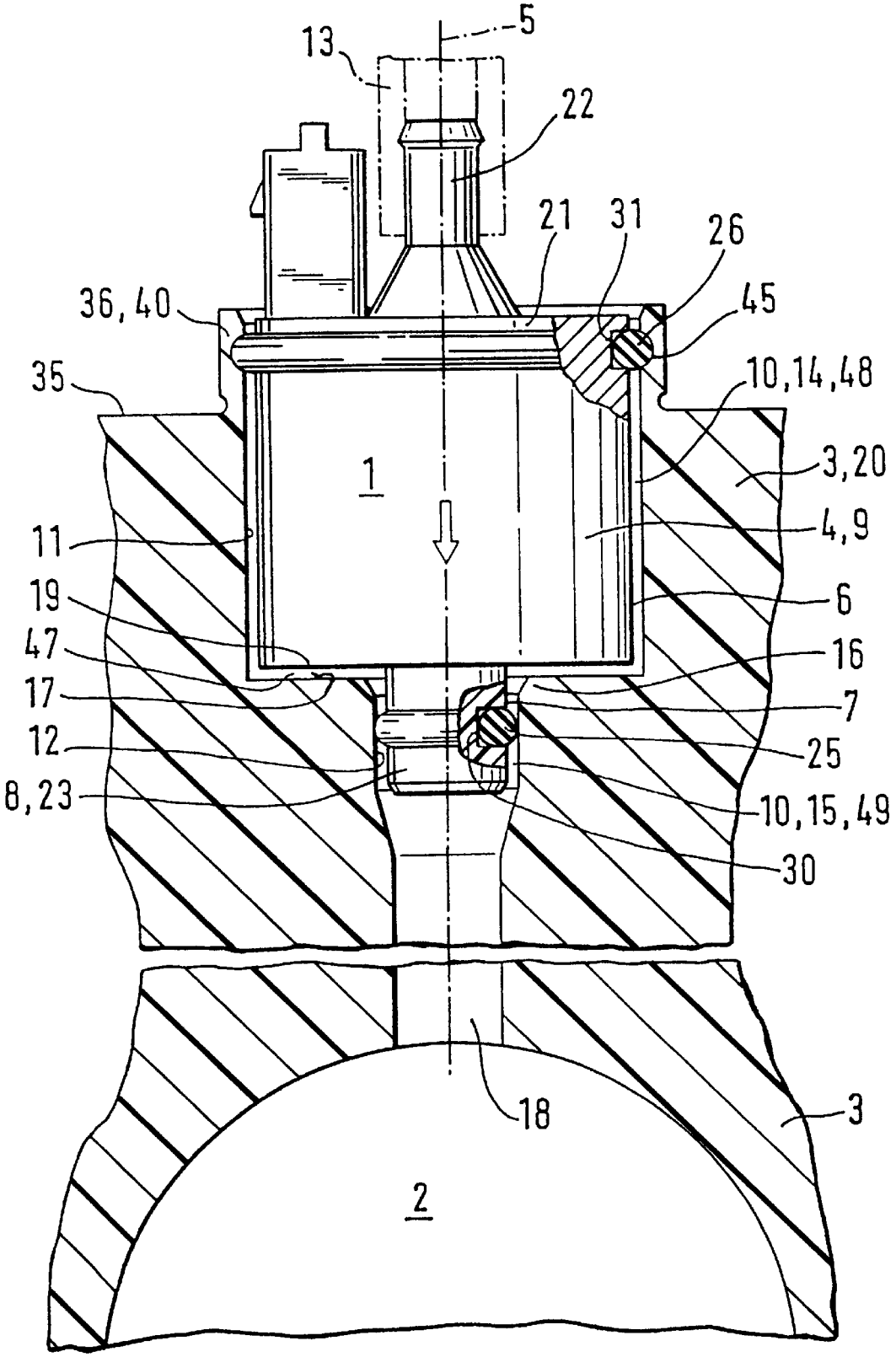
FIG. 1 shows a fragmentary sectional side view of a unit embodied according to the invention, in a first exemplary embodiment of the invention.

The unit, hereinafter identified by reference numeral 1, is intended for an internal combustion engine and to that end is introduced into an installation wall 20 of an operating medium line 2 of the engine. The operating medium line 2 may, as shown in FIG. 1, for example be an intake tube of the engine, through which the engine can aspirate air from the environment, to which air, by means of a unit 1 embodied for instance as a conventional injection valve, adds fuel for subsequent combustion in combustion chambers of the engine. The design of an injection valve is well known to one skilled in the art, for instance from U.S. Pat. No. 5,156,133 or British Patent GB 1 603 501.

However, it is also possible that the unit 1 is a multiposition valve of a switchover device, which by way of example is equipped with an actuator, to enable changing the length of the intake tube by switching. Switchover devices of this kind for engines equipped with so-called ram intake tube supercharging are well known to one skilled in the art, for instance from German Patent Disclosure DE-OS 41 05 938.

The operating fluid line may also be a throttle valve neck of the engine, in which a throttle device, for instance in the form of a throttle valve, is accommodated rotatably, so that with the throttle device, the air flowing in the throttle valve neck or operating fluid line 2 can be controlled. A unit embodied as an idling regulating valve, for controlling the quantity of idling air, may be mounted in a bypass around the throttle device on the throttle valve neck. Such a design is well-known to one skilled in the art, for instance from U.S. Pat. No. 5,497,746.

The operating fluid line may also, however, be an exhaust gas recirculation line, on which an exhaust gas recirculation valve is mounted, in order to control the exhaust gas stream accordingly. The design of such a valve is well known to one skilled in the art, for instance from International Patent Disclosure WO 95/27134.

Below, the invention will be described for example in terms of a valve 1 that is also a unit for an internal combustion engine and that is intended for instance for the metered introduction of fuel, which has evaporated from a fuel tank of an engine, into the operating fluid line 2 of the engine. The operating fluid line 2 is for example an intake conduit 2 of an intake module 3 of the engine. The valve 1 is introduced into a recess 10 of the installation wall 20 of the operating fluid line 2 or intake module 3. The valve 1, shown schematically simplified in a fragmentary sectional side view in FIG. 1, is embodied as electromagnetically actuatable and for example is part of a fuel vapor trapping system of an internal combustion engine, not shown in further detail, whose design and function can be learned for instance from Bosch Technical Instruction, Motormanagement Motronic, Second Edition, August 1993, pp. 48 and 49. The design and mode of operation of such a valve 1, also known to one skilled in the art as a regeneration valve or tank venting valve, is known from German Patent Disclosure DE-OS 40 23 044, which is hereby expressly incorporated by reference in the present patent application.

The valve 1 has a housing 4, which is preferably of plastic and is made for example by plastic injection molding. The valve 1 is used to introduce the fuel, trapped by the fuel vapor trapping system, into the intake conduit 2 of the intake module 3 of the engine. Like the housing 4 of the valve 3, the intake module 3 preferably comprises a plastic that can withstand the high stresses in terms of strength and high temperatures of the engine. An example of a suitable plastic for this purpose is polyamide.

The housing 4 of the valve 1 is embodied as cylindrically stepped and is composed of a first encompassing outer face 7 of smaller cross section of a first portion 8 and a second encompassing outer face 6 of larger cross section of a second portion 9. The valve 1 is introduced at least part way into the recess 10, which corresponding to the outer faces 6, 7 of the valve is embodied as stepped, in the intake module 3, and the recess 10 is composed along a longitudinal axis 5 of a part 14 of larger cross section, with an inner face 11 of larger cross section, and a part 15 of smaller cross section, with an inner face 12 of smaller cross section. Formed between the two parts 14, 15 is a shoulder 16, which has an annular face 17. The two parts 14, 15 extend centrally to the longitudinal axis 5 and have a cylindrical cross section, which is somewhat larger than the respective cylindrical cross section of the portions 8 and 9 of the valve 1, which cross section is received in the parts 14, 15 and defined by the outer faces 6, 7, so that in the installed state of the valve 1, two radial gaps 48, 49 are formed between the outer faces 6, 7 and the inner faces 11, 12. The inner face 12 of smaller cross section changes over into a conduit 18, which discharges into the intake conduit 2, through which the engine can aspirate air from the environment for subsequent mixture formation. The delivery of fuel, temporarily stored by the fuel vapor trapping system, to the valve 1 is effected for instance via an auxiliary valve 13, which is embodied for instance as a hose and is mounted on an inflow neck 22 provided on an upper housing part 21 of the valve 1. From an outflow neck 23 of the valve 1, which here corresponds to the first portion 8 and is opposite the inflow neck 22, the fuel is dispensed out of the conduit 18 into the intake conduit 2, preferably downstream of a throttle valve rotatably supported in the intake conduit 2 of the intake module 3. The valve 1 in its interior, controls a through cross section, for instance by means of a closing body cooperating with a valve seat.

As the medium, fuel in vapor form, for instance, and air flow in the through cross section via the auxiliary valve 13 into the valve 1, in order subsequently to dispense this fuel-air mixture, for instance in clocked fashion, out of the outflow neck 23 into the conduit 18.

According to the invention, two sealing rings 21, a first sealing ring 25 of smaller cross section and a second sealing ring 26 of larger cross section, are provided on the outer faces 6 and 7 of the valve 1. The sealing rings 25, 26 serve according to the invention not only to seal off the valve 1 in the recess 10 but also to support and secure the valve 1 in the recess 10. To that end, both sealing rings 25, 26 are of an elastic material, preferably rubber. The sealing rings 25, 26 are embodied for instance as so-called O-rings, which have a circular cross section. As shown in the drawing, the first sealing ring 25 is placed in a first annular groove 30, recessed out of the outer face 7, of the first portion 8 of the housing 4. The second sealing ring 26 is placed in the same way in a second annular groove 31, recessed out of the second outer face 6, of the second portion 9 of the housing 4. Both sealing rings 25, 26 protrude radially past their respective outer faces 6, 7 and are deformed elastically upon introduction of the valve 1 into the recess 10, in the process of which they radially guide the valve 1, but the radial gaps 48, 49 still remain between the inner faces 11, 12 of the recess 10 and the outer faces 6, 7 of the valve 1.

Figure 2:
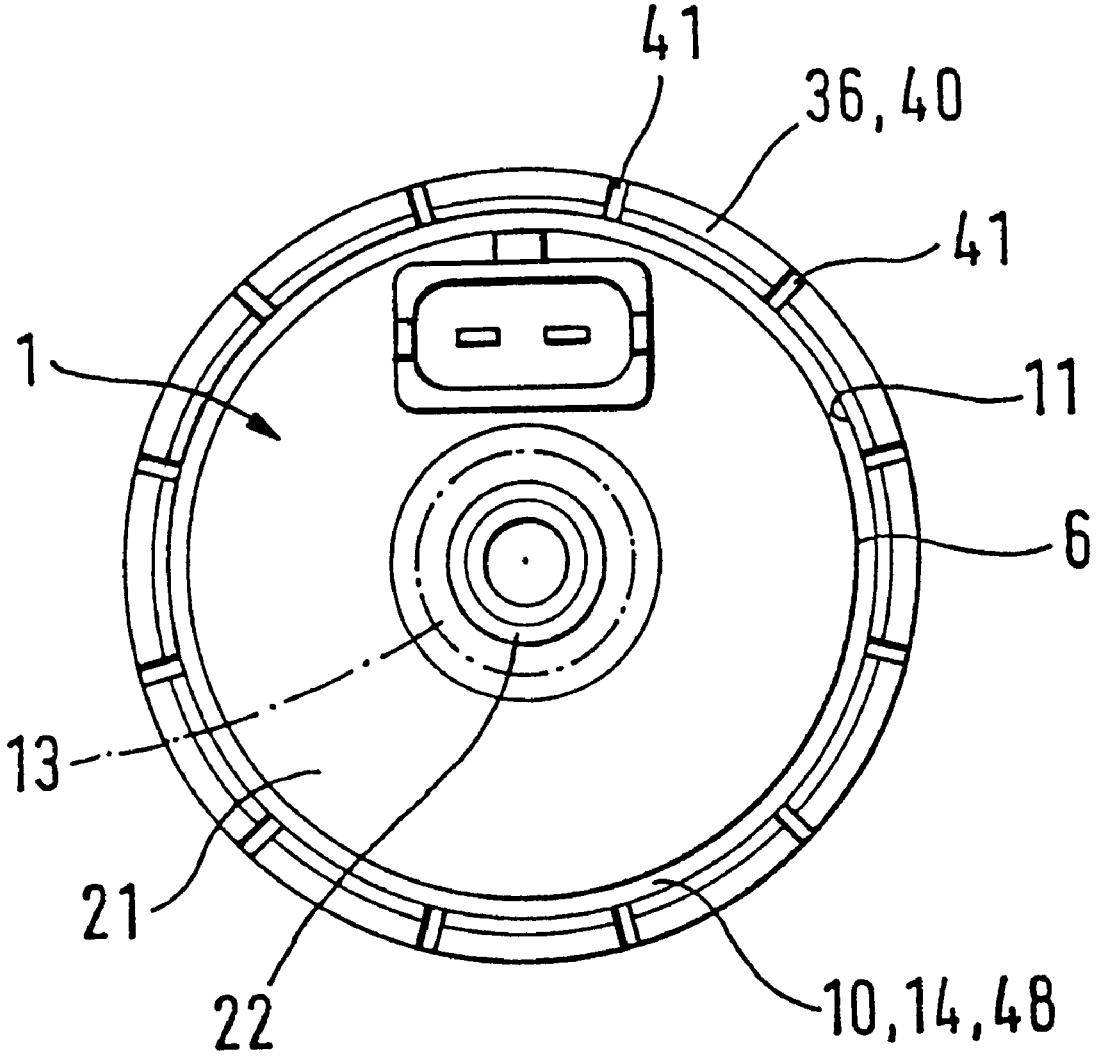
FIG. 2 is a plan view of the unit of FIG. 1.

The inner face 11 of larger cross section of the recess 10 is partly formed by a tubular protruberance 36 past an end face 35 of the intake module 3. As shown in FIG. 2, which is a plan view on FIG. 1, the tubular protruberance 36 is composed of a plurality of ring-snap elements 40. The ring-snap elements 40, which form a snap device for retaining the valve 1, are separated from one another on the circumference by notches 41 extending parallel in the direction of the longitudinal axis 5, so that by way of example twelve tonguelike ring-snap elements 40 are provided, which are distributed uniformly along the circumference of the protruberance 36. The individual ring-snap elements 40 are embodied as bendable, for instance being of plastic, and upon introduction of the valve 1 they can bend out of the way of the housing 4 of the valve 1 accordingly. The tubular protruberance 36 with the ring-snap elements 40, for instance like the intake module 3 is of plastic and is injected jointly, for instance by plastic injection molding, with it in the production of the intake module 3.

As shown in FIG. 1, the tubular protruberance 36, protruding past the end face 35 of the intake module 3, has an encompassing groovelike indentation 45 in the inner face 11 of larger cross section, which extends along the individual ring-snap elements 40 and is intended for receiving the second sealing ring 26 of larger cross section. Upon introduction of the valve 1 into the recess 10, the valve, with the outflow neck 23, passes from part 14 of larger cross section into the part 15 of smaller cross section of the recess 10, and the first sealing ring 25 of smaller cross section slides along the inner face 12 in the part 15 of smaller cross section until the second sealing ring 26 snaps into the groovelike indentation 45 of the ring-snap elements 40, which are then bent open somewhat. The axial spacings of the second sealing ring 26 or second annular groove 31 and of the groovelike indentation 45 in the inner face 31 from the annular face 17 are selected such that an axial gap 47 results between the annular face 17 and an annular valve face 19 that remains between the outer face 6 of larger cross section and the outer face 7 of smaller cross section. The axial gap 47 and the radial gaps 48, 49 preclude any contact of the valve 1 with faces 11, 12 and 17 in the recess 10.

Because of the form-locking reception of the second sealing ring 26 of larger cross section in the annular indentation 45 and annular groove 31, a quasi-fixed bearing for the valve 1 in the recess 10 is brought about. The first sealing ring 25 of smaller cross section then rests only radially sealingly on the inner face 12 in the part 15 of smaller cross section of the recess 10 and is therefore unhindered in its axial displaceability in the direction of the longitudinal axis 5, so that there a quasi-loose bearing for the valve 1 is formed. Because the valve 1 is supported solely by means of two sealing rings 25, 26, in such a way that no contact of the outer faces 6, 7 of the valve with the inner faces 11, 12 in the recess 10 can occur, an elastic bearing is created, which prevents vibration originating at the valve 1 from being transferred to the intake module 3. This creates an acoustical decoupling of the valve 1 in the recess 10, which greatly reduces the propagation of the operating noise of the valve 1. Moreover, the elastically deformed sealing rings 25, 26 assure that there is an adequate mechanical hold of the valve 1 in the recess 10.

For unmounting the valve 1, a U-shaped wedge, for instance, can be introduced into the gap 48 between the ring-snap elements 40 and the outer face 6. On being introduced into the gap 48, the wedge bends the ring-snap elements 40 open somewhat, so that the snap connection between the second sealing ring 26 and the ring-snap elements 40 is undone, and the valve 1 can be removed from the recess 10. As shown in FIG. 1, the ring-snap elements 40 may be embodied in one piece on the intake module 3 on the shoulder 36 and can be jointly injection molded in a simple way when the intake module 3 is produced, for instance by plastic injection molding.

Figure 3:
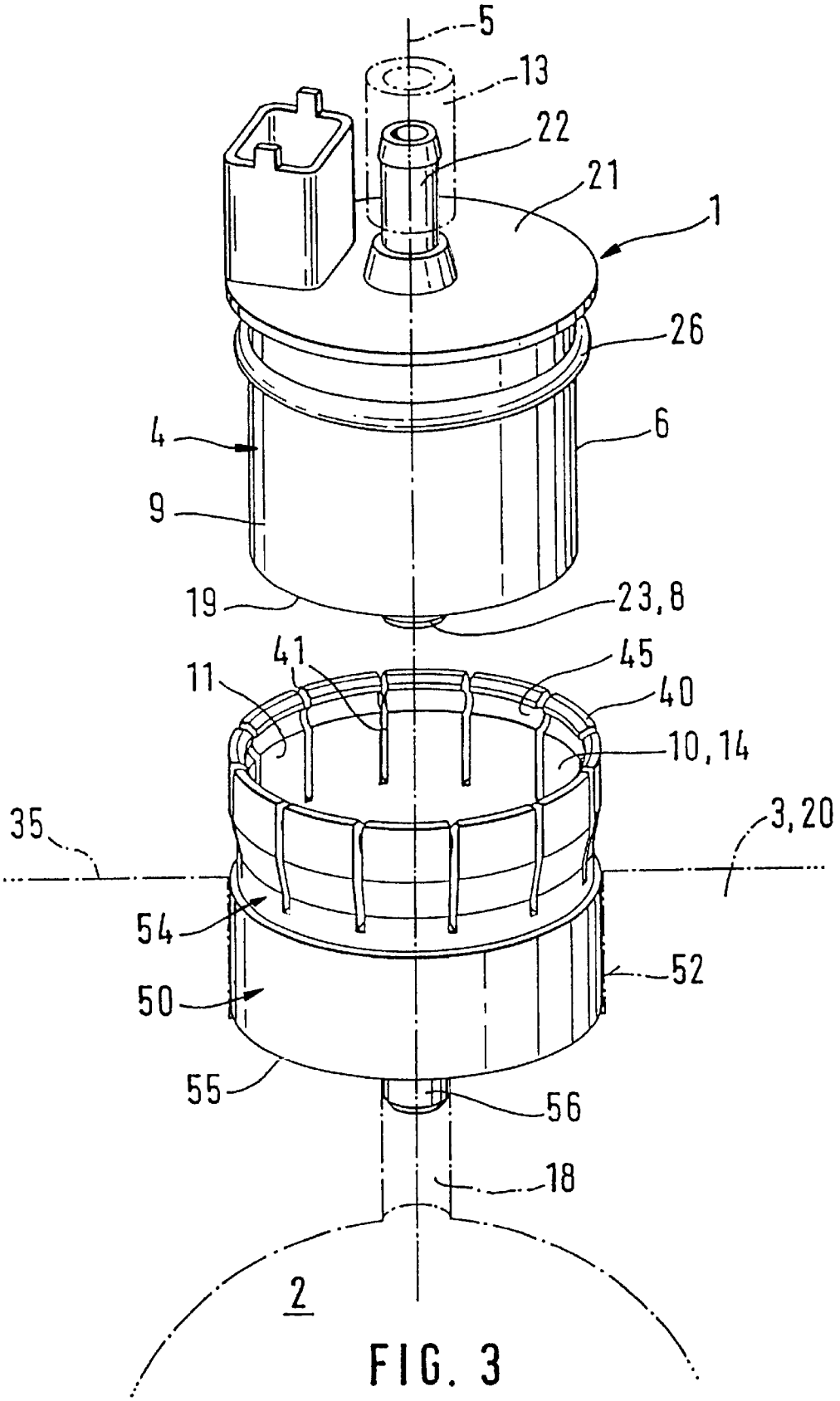
FIG. 3 is a perspective view of the unit of the invention with its associated fastening, in a second exemplary embodiment of the invention.

FIG. 3 shows a second exemplary embodiment of the invention, in which all the parts that are the same or function the same are identified by the same reference numerals as in FIGS. 1 and 2. In FIG. 3, the valve 1 is shown in perspective, and for securing or retention it is introduced into a separate component, embodied as an installation pot 50. The installation pot 50 has the ring-snap elements 40 on its circumference, over a portion of its axial length, and forms the recess 10 for the valve 1. The preferably plastic installation pot 50 has an encompassing annular rim 54 with the ring-snap elements 40 and a pot bottom 55 and optionally an attached neck 56, adjoining the pot bottom 55, and is intended for instance, for intake modules 3 made of metal, for securing the valve 1 to the intake module 3. To that end, the installation pot 50 is introduced for instance into a cylindrical recess 52 in the metal intake module 3, which recess is embodied to correspond to the outer shape of the installation pot 50 and is indicated in section in dashed lines in FIG. 3, and secured in this recess, for instance by adhesive bonding. After that, the valve 1 can be introduced into the installation pot 50 and retained on the installation pot 50 by means of the ring-snap elements 40. Naturally, it is also possible to insert the installation pot 50 into a cylindrical recess of a plastic intake module 3, so as to secure the valve 1 to the intake module 3 in that way.

It should be mentioned once again that the invention is not limited to a valve for metered introduction of evaporated fuel. The unit may also be an injection valve of a known design, such as that known for instance from U.S. Pat. No. 5,156,133 or British Patent GB 1 603 501. The invention can also be readily adopted for so-called exhaust gas recirculation valves, of the kind known for instance from International Patent Disclosure WO 95/27134. The invention is equally suitable for other valves, for instance valves for regulating idling in the internal combustion engine, of the kind known for instance from U.S. Pat. No. 5,497,746. Its adoption to so-called switchover or multiposition valves in internal combustion engines equipped with ram intake tube supercharging, as known for instance from German Patent Disclosure DE-OS 41 05 938, is also possible.

The foregoing relates to preferred exemplary embodiments of the invention, it being understood that other variants and embodiments thereof are possible within the spirit and scope of the invention, the latter being defined by the appended claims.

We claim:

1. A unit for an internal combustion engine, comprising a housing with a first portion having a first encompassing outer face and at least one second portion with at least one second encompassing outer face, wherein a first sealing ring can be mounted on the first outer face, and the first portion and first sealing ring can be introduced into a recess of an installation wall, a second sealing ring (26) can be mounted on the second outer face (6) of the second portion (9), and the second portion (9) and second sealing ring (26) can likewise be introduced into the recess (10), so that the support of the unit (1) in the recess (10) is effected by means of the two sealing rings (25, 26), without the first and second outer faces (6, 7) of the unit (1) resting on inner faces (11, 12) of the recess (10); and that the installation wall (20) has a tubular protruberance (36), into which the recess (10) extends and which is subdivided, for retaining the unit (1), into a plurality of bendable ring-snap elements (40), into which the second sealing ring (26) can be snapped when the unit (1) is introduced into the recess (10).

2. The unit in accordance with claim 1, in which the first sealing ring (25) is introduced into a first annular groove (30) provided on the first outer face (7) of the unit (1).

3. The unit in accordance with claim 1, in which the second sealing ring (26) is introduced into a second annular groove provided on the second outer face (6) of the unit (1).

4. The unit in accordance with claim 1, in which the second sealing ring (26) can be snapped into a groovelike indentation (45) provided in the inner face (11) of the ring-snap elements (40).

5. The unit in accordance with claim 1, in which a gap (48, 49) is recessed out between the outer faces (6, 7) of the unit (1) and the inner faces (11, 12) of the recess (10).

6. The unit in accordance with claim 1, in which the installation wall (20) comprises plastic.

7. The unit in accordance with claim 1 in which the installation wall (20) is part of an intake module (3) of the engine.

8. The unit in accordance with claim 1, in which the installation wall (20) is part of an installation pot (50), which is disposed on an intake module (3) or an intake line of the engine.

9. The unit in accordance with claim 8, in which the installation pot (50) comprises plastic.

10. The unit in accordance with claim 1, in which the unit (1) is intended for controlling a through cross section in an auxiliary valve (13) that delivers a medium to an operating medium line (2) of the engine.

11. The unit in accordance with claim 1, in which the unit (1) is embodied as a valve for a metered introduction of evaporated fuel.

12. A unit for metered introduction of evaporated fuel into an operating medium line of an internal combustion engine, comprising a first portion with a first encompassing outer face and at least one second portion with at least one second encompassing outer face, wherein a first sealing ring can be mounted on the first outer face, a second sealing ring (26) can be mounted on the second outer face (6) of the second portion (9), and the first portion and first sealing ring can be introduced into a recess of an installation wall (20), and the second portion (9) and second sealing ring (26) can likewise be simultaneously introduced into the recess (10), so that the support of the unit (1) in the recess (10) is effected by means of the first and second sealing rings (25,26), without the first and second outer faces (6,7) of the unit (1) resting on inner faces (11, 12) of the recess (10).

13. The unit in accordance with claim 12, in which the installation wall (20) has tubular protruberance (36), into which the recess (10) extends and which is subdivided, for retaining the unit (1), into a plurality of bendable ring-snap elements (40), into which the second sealing ring (26) can be snapped when the unit (1) is introduced into the recess (10).

14. The unit in accordance with claim 12, in which the first sealing ring (25) is introduced into a first annular groove (30) provided on the first outer face (7) of the unit (1).

15. The unit in accordance with claim 12, in which the second sealing ring (26) is introduced into a second annular groove provided on the second outer face (6) of the unit (1).

16. The unit in accordance with claim 12, in which the second sealing ring (26) can be snapped into a groovelike indentation (45) provided in the inner face (11) of the ring-snap elements (40).

17. The unit in accordance with claim 12, in which a gap (48, 49) is recessed out between the outer faces (6, 7) of the unit (1) and the inner faces (11, 12) of the recess (10).

18. The unit in accordance with claim 12, in which the installation wall (20) comprises plastic.

19. The unit in accordance with claim 12, in which the installation wall (20) is part of an intake module (3) of the engine.

20. The unit in accordance with claim 12, in which the installation wall (20) is part of an installation pot (50), which is disposed on an intake module (3) or an intake line of the engine.

21. The unit in accordance with claim 20, in which the installation pot (50) comprises plastic.

22. A snap device for retaining a unit for an internal combustion engine, comprising a housing with a first portion having a first encompassing outer face and at least one second portion with at least one second encompassing outer face, wherein a first sealing ring can be mounted on the first outer face, and the first portion and first sealing ring can be introduced into a recess of an installation wall, a second sealing ring (26) can be mounted on the second outer face (6) of the second portion (9), and the second portion (9) and second sealing ring (26) can likewise be introduced into the recess (10), so that a support of the unit (1) in the recess (10) is effected by means of the first and second sealing rings (25, 26), without the first and second outer faces (6, 7) of the unit (1) resting on inner faces (11, 12) of the recess (10); and that the installation wall (20) has a tubular protruberance (36), into which the recess (10) extends and which is subdivided, for retaining the unit (1), into a plurality of bendable ring-snap elements (40), into which the second sealing ring (26) can be snapped when the unit (1) is introduced into the recess (10).

23. The snap device in accordance with claim 22, in which the unit (1) is intended for controlling a through cross section in an auxiliary valve (13) that delivers a medium to an operating medium line (2) of the engine.

24. The snap device in accordance with claim 22, in which the second sealing ring (26) can be snapped into a groovelike indentation (45) provided in the inner face (11) of the ring-snap elements (40).

25. The snap device in accordance with claim 22, in which a gap (48, 49) is recessed out between the outer faces (6, 7) of the unit (1) and the inner faces (11, 12) of the recess (10).

26. The snap device in accordance with claim 22, in which the snap device comprises plastic.

27. The snap device in accordance with claim 22, in which the snap device is part of an intake module (3) of the engine.

28. The snap device in accordance with claim 22, in which the snap device is part of an installation pot (50), which is disposed on an intake module (3) or an intake line of the engine.

29. The snap device in accordance with claim 22, in which the installation pot (50) comprises plastic.

* * * * *